US005093566A

United States Patent [19]

Van Aller

[11] Patent Number: 5,093,566

[45] Date of Patent: Mar. 3, 1992

[54] RADIATION DETECTOR FOR ELEMENTARY PARTICLES

[75] Inventor: Gerardus Van Aller, Heerlen, Netherlands

[73] Assignee: U.S. Philips Corporation, New York, N.Y.

[21] Appl. No.: 548,346

[22] Filed: Jun. 29, 1990

[30] Foreign Application Priority Data

Jul. 5, 1989 [NL] Netherlands ..... 8901711

[51] Int. Cl.[5] ..... H01J 31/50

[52] U.S. Cl. ..... 250/213 VT; 313/527

[58] Field of Search ..... 250/213 VT, 207; 313/527, 529, 530, 537, 540, 541, 544

[56] References Cited

U.S. PATENT DOCUMENTS 3,896,331 7/1975 Enck, Jr. et al. ..... 250/213 VT
4,087,683 5/1978 Leib ..... 250/213 VT
4,173,727 11/1979 Vine ..... 313/529
4,213,055 7/1980 Schrijvers et al. .
4,315,184 2/1982 Santilli et al. ..... 313/529
4,564,754 1/1986 Van Aller et al. .
4,645,971 2/1987 Ricodeau ..... 313/527
4,658,128 4/1987 Beierlien ..... 250/213 VT
4,740,683 4/1988 Noji et al. ..... 313/527

*Primary Examiner*—David C. Nelms
*Assistant Examiner*—K. Shami
*Attorney, Agent, or Firm*—William L. Botjer

[57] ABSTRACT

Via the shape of the photocathode surface and the geometry and potential distribution of electrodes of the electron-optical system, an X-ray image intensifier tube is optimized for reduction of the transit time variance for photoelectrons from the photocathode surface to a photoelectron detector. The photoelectron detector, on which an image need not be formed in this case, has, for example, a comparatively small entrance surface and is arranged in or near a cross-over of the photoelectrons.

9 Claims, 1 Drawing Sheet

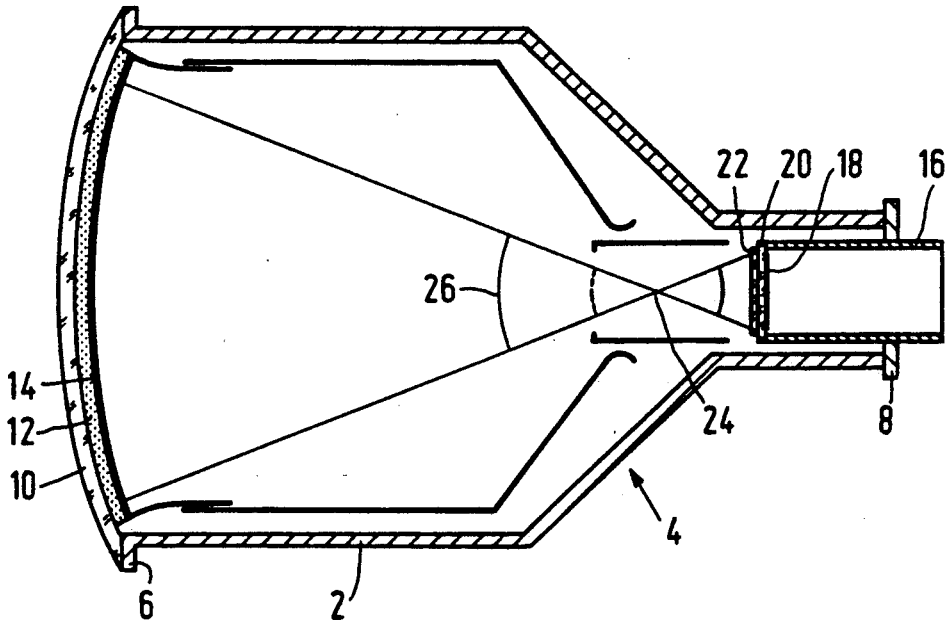
22
20
18
16
26
14
12
10
24
8
4
6
2

RADIATION DETECTOR FOR ELEMENTARY PARTICLES

FIELD OF THE INVENTION

The invention relates to a radiation detector, comprising an entrance screen for conversion of radiation to be measured into photoelectrons, and an electron-optical system for accelerating the photoelectrons to an exit screen.

BACKGROUND OF THE INVENTION

A radiation detector of this kind is known from U.S. Pat. No. 4,213,055. Therein, radiation detector in the form of an X-ray image intensifier tube comprises an entrance screen which is provided on a metal support and comprises a luminescent material and a photocathode. In a tube of this kind an image-carrying beam of photoelectrons is imaged on an exit screen which comprises a phosphor layer for conversion of the photoelectrons into light. The electron-optical system in a tube of this kind is adapted to form an optimum image of the image-carrying beam of photoelectrons on an exit screen.

SUMMARY OF THE INVENTION

For the detection of radiation, for example as caused by muons, neutrinos and the like, it is not important that an image is formed by means of the photoelectrons. It is of primary importance, however, that individual radiation quanta can be individually detected. One requirement to be imposed on the detector in this respect consists in that the transit time of the photoelectrons should be uniform to a high degree for the entire surface of the entrance screen. It is inter alia an object of the invention to satisfy said requirement; to achieve this, a radiation detector of the kind set forth in accordance with the invention is characterized in that the curvature of the photocathode surface and/or the geometry of the electron-optical system are optimized so as to achieve a substantially uniform field strength across the photocathode surface.

Because in a detector in accordance with the invention, based on an image intensifier tube, imaging quality is sacrificed for the benefit of a uniform field strength through an adapted geometry of the screen and the electrodes, a difference in transit time of the photoelectrons which normally amounts to approximately 10 ns is reduced to, for example 1 ns.

According to a first method of achieving this object, an optimum electrode configuration and potential distribution are calculated for an as uniform as possible field strength across the entire photocathode in a model based on a realistically adapted shape of the entrance screen which is preferably provided directly on a glass entrance window in the present case. According to a further method, based on a realistic electron-optical system, for example for a desirable basic shape and reasonable potentials, a curvature is calculated for the entrance screen for which the field strength thereacross is again optimally uniform. The uniformity can be further enhanced by iteration of these two methods.

In order to reduce the effect of the starting speed of the photoelectrons and the spread in the angle of emergence thereof, the photocathode field strength should be comparatively high. This can also be realised by way of the shape and the potentials of the electron-optical system.

In a preferred embodiment, the variance of the starting speed of the photoelectrons is reduced by providing the entrance screen with a wavelength-selective filter. On the one hand a wavelength can thus be selected from the spectrum of radiation to be detected, whilst on the other hand a spread in the starting energy of the liberated photoelectrons can be reduced.

In order to reduce background radiation from radioactive decay in construction material of the detector, for example glass of the detector tube, a further preferred embodiment is made of metal as much as possible, the entrance window and the exit window consisting of a low-thorium and low-uranium glass.

In order to minimize the overall transit time between the liberation of photoelectrons and the detection of an electronic detection pulse thus generated, an embodiment of the entrance screen utilizes a fast p47 phosphor.

It is to be noted that U.S. Pat. No. 4,564,753 describes a radiation detector which serves to realise a large detection opening and a short detection time. Uniformity of the transit time of photoelectrons is of secondary importance therein.

Some preferred embodiments in accordance with the invention will be described in detail hereinafter with reference to the drawing.

DESCRIPTION OF PREFERRED EMBODIMENTS

The sole FIGURE of the drawing shows a cylindrical wall portion 2 of a radiation detector in accordance with the invention, which wall portion is made of metal and comprises a flared portion 4, an entrance flange 6 and an end 8. At an entrance side there is situated an entrance window 10 which is preferably made of glass or another material which is translucent to radiation to be detected or to radiation to be produced by said radiation in a conversion layer which is provided on the outer side of the entrance window and which is not shown. On the inner side of the entrance window there are provided a conversion layer 12 and a photocathode 14. As has already been stated, the conversion layer 12 may alternatively be provided on the outer side of the window 10. At an exit side the detector is closed by way of a detector element 16, for example a photomultiplier with a photocathode 18 provided on a window 20 on a front side of which there is provided a phosphor layer 22. The detector element, however, can alternatively be formed by a matrix of photodetectors or a single photodetector, or by a matrix of electron detectors or a single electron detector. Because imaging is not the aim, an entrance plane of the detector element may also be positioned at the area of a cross-over 24 of the beam of photoelectrons 26. In order to avoid geometrical differences in transit time, in the case of a comparatively large detector entrance face it may be advantageous to construct this face so as to be substantially spherical, the centre of curvature being coincident with the cross-over 24. In the case of a direct electron detector, it may be advantageous to decelerate the photoelectrons initially, for example by means of an additional electrode, so that the electron detector can be sensitive to comparatively slow electrons. The decelaration of the photoelectrons results in a longer transit time, but need not cause a greater variance in transit time when the electrode configuration is suitably chosen, and at the same time a comparatively strong field strength can be sustained on the photocathode surface.

The phosphor layer 22 preferably consists of a phosphor having a short afterglow time, like the luminescent material containing yttrium as disclosed in U.S. Pat. No. 4,564,753, so that a high count rate is achieved for radiation quanta to be detected.

I claim:

1. A radiation detector, comprising an entrance screen for conversion radiation to be measured into photoelectrons, a curved photocathode disposed on said entrance screen and an electron-optical system for accelerating the photoelectrons to an exit screen, characterized in that the curvature of the photocathode surface and the geometry of the electron-optical system are constructed and arranged to achieve a substantially uniform field strength across the surface of the curved photocathode.

2. A radiation detector as claimed in claim 1, characterized in that differences in transit time of photoelectrons from the entire photocathode surface to a detector entrance face are reduced to no more than 1 ns.

3. A radiation detector as claimed in claim 1, characterized in that a comparatively high field strength can be applied across the entire photocathode surface through a suitable electrode configuration and potential distribution.

4. A radiation detector as claimed in claim 1, characterized in that the entrance screen comprises a luminescent layer which is provided on an inner side or on an outer side of an entrance window and which serves for converting radiation to be detected into radiation whereto the photocathode is sensitive.

5. A radiation detector as claimed in claim 1, characterized in that the entrance screen comprises a wavelength-selective filter.

6. A radiation detector as claimed in claim 1, characterized in that an exit screen comprises a phosphor containing yttrium.

7. A radiation detector as claimed in claim 1, characterized in that for the detection of the photoelectrons a detector entrance face is positioned in or near a crossover of the photoelectrons.

8. A radiation detector as claimed in claim 1, characterized in that a photoelectron detector is contructed as a single, semiconductor detector.

9. A radiation detector as claimed in claim 4, further including an envelope characterized in that non-window portions of the envelope are made of glass and that the windows are made of low-uranium and low-thorium glass.

* * * * *